US008944152B2

(12) United States Patent
Kulankara et al.

(10) Patent No.: US 8,944,152 B2
(45) Date of Patent: Feb. 3, 2015

(54) COMPACT EVAPORATOR FOR CHILLERS

(75) Inventors: Satheesh Kulankara, York, PA (US); Michael Lee Buckley, Abbottstown, PA (US); Mustafa Kemal Yanik, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 1174 days.

(21) Appl. No.: 12/839,658

(22) Filed: Jul. 20, 2010

(65) Prior Publication Data

US 2011/0017432 A1 Jan. 27, 2011

Related U.S. Application Data

(60) Provisional application No. 61/227,640, filed on Jul. 22, 2009.

(51) Int. Cl.
*F28D 5/02* (2006.01)
*F28B 9/10* (2006.01)
(Continued)

(52) U.S. Cl.
CPC .. *F28D 7/16* (2013.01); *F28D 3/02* (2013.01); *F28D 21/0017* (2013.01); *F28F 9/005* (2013.01); *F28F 9/22* (2013.01); *F25B 39/02* (2013.01); *F28D 2021/0071* (2013.01); *F28F 2009/222* (2013.01); *F25B 2339/0242* (2013.01); *F25B 2500/28* (2013.01)
USPC ..... 165/115; 165/113; 165/114; 165/116; 165/117; 62/259.4; 62/515; 62/524; 62/527

(58) Field of Classification Search
CPC ..... F25B 41/06; F25B 39/02; F28D 7/16; F28D 7/163; F28D 7/1646; F28D 2009/222
USPC ..... 165/113–117; 62/259.4, 515, 524, 527
See application file for complete search history.

(56) References Cited

U.S. PATENT DOCUMENTS 2,012,183 A 8/1935 Carrier
2,059,725 A * 11/1936 Carrier ..... 62/394
(Continued)

FOREIGN PATENT DOCUMENTS

CN 1409810 A 4/2003
CN 101052854 A 10/2007

OTHER PUBLICATIONS

CN Office Action for Patent Application 2010800300468, national stage of PCT/US2010/042617; Mailing Date: Feb. 20, 2013.
(Continued)

*Primary Examiner* — Frantz Jules
*Assistant Examiner* — Erik Mendoza-Wilkenfe
(74) *Attorney, Agent, or Firm* — McNees Wallace & Nurick LLC

(57) ABSTRACT

A compact evaporator including a suction baffle system is provided for use in a refrigeration system. The suction baffle system includes a suction baffle and a passageway. The suction baffle includes a plurality of walls and is adjacent to the interior wall of shell. The passageway extends below one of the walls of the suction baffle toward the lower portion of the shell and is adjacent to the interior wall of the shell. A suction tube having an inlet is attached to the evaporator shell and the inlet is adjacent to the passageway and located partially below the suction baffle. The passageway minimizes the possibility of liquid carry-over in the suction tube that feeds into the compressor.

5 Claims, 9 Drawing Sheets

(51) Int. Cl.

| | |
|---|---|
| ***F25D 23/12*** | (2006.01) |
| ***F25B 39/02*** | (2006.01) |
| ***F28D 7/16*** | (2006.01) |
| ***F28D 3/02*** | (2006.01) |
| ***F28D 21/00*** | (2006.01) |
| ***F28F 9/00*** | (2006.01) |
| ***F28F 9/22*** | (2006.01) |

(56) References Cited

U.S. PATENT DOCUMENTS

| | | | | | |
|---|---|---|---|---|---|
| 2,354,497 | A | * | 7/1944 | Brizzolara | 62/219 |
| 2,453,662 | A | * | 11/1948 | Graham | 165/114 |
| 2,504,710 | A | * | 4/1950 | Ludman et al. | 122/382 |
| 2,986,377 | A | * | 5/1961 | Naab | 165/114 |
| 3,141,311 | A | * | 7/1964 | McGrath et al. | 62/510 |
| 3,197,387 | A | * | 7/1965 | Lawrance | 202/173 |
| 3,240,265 | A | * | 3/1966 | Weller | 165/108 |
| 3,267,693 | A | * | 8/1966 | Richardson et al. | 62/527 |
| 3,412,569 | A | * | 11/1968 | Arledge, Jr. | 62/115 |
| 3,538,983 | A | * | 11/1970 | Thomae et al. | 165/113 |
| 5,246,541 | A | * | 9/1993 | Ryham | 159/13.2 |
| 5,645,124 | A | * | 7/1997 | Hartfield et al. | 165/117 |
| 5,667,005 | A | * | 9/1997 | Kakutani et al. | 165/114 |
| 6,868,695 | B1 | | 3/2005 | Dingel et al. | |
| 7,707,850 | B2 | | 5/2010 | Wang et al. | |
| 2002/0162352 | A1 | | 11/2002 | Ring et al. | |
| 2006/0080998 | A1 | | 4/2006 | De Larminat et al. | |
| 2008/0097118 | A1 | * | 4/2008 | Bartos et al. | 562/408 |
| 2008/0148767 | A1 | * | 6/2008 | De Larminat et al. | 62/498 |
| 2008/0149311 | A1 | * | 6/2008 | Liu et al. | 165/115 |
| 2009/0165497 | A1 | | 7/2009 | Welch | |

OTHER PUBLICATIONS

International Search Report and Written Opinion received in PCT/US2010/042617, Feb. 20, 2013

* cited by examiner

COMPACT EVAPORATOR FOR CHILLERS

CROSS REFERENCE TO RELATED PATENT APPLICATIONS

This application claims priority from and the benefit of U.S. Provisional Application No. 61/227,640, entitled EVAPORATOR, filed Jul. 22, 2009, which is hereby incorporated by reference.

BACKGROUND

An evaporator may be used in various systems, including a vapor compression chiller system whose primary components include a compressor, a condenser, an expansion device and the evaporator. The main components of the chiller system are interconnected to create a conventional closed-loop refrigeration circuit.

In basic operation of a vapor compression chiller system, the compressor discharges compressed gaseous refrigerant through a discharge line to the condenser, in which a cooling fluid cools and condenses the refrigerant. The condensed refrigerant is transferred from the condenser to the expansion device, wherein the refrigerant cools by expansion before entering an evaporator inlet of the evaporator as a two-phase mixture of liquid and vapor refrigerant. The two phase refrigerant mixture is distributed across a tube bundle provided within a shell of the evaporator. The refrigerant flows between the tubes, and in passing across the exterior of the tubes of the tube bundle, cools a heat absorbing fluid, which passes through the interior of the tubes of the tube bundle. The heat absorbing fluid is typically water or a water/glycol mixture. For the purposes of present discussion, the fluid is assumed to be water. The chilled water can then be pumped to remote locations for various cooling purposes.

The chilled water vaporizes the liquid portion of the refrigerant mixture that passes through and across the tube bundle. The vapor refrigerant is drawn by pressure differential toward a suction inlet or an evaporator outlet attached to the evaporator shell. Baffles in the evaporator help insure that primarily only the vapor portion of the refrigerant is conveyed to the suction inlet of the suction tube. From the suction tube, a suction line or pipe conveys vapor refrigerant to an inlet of the compressor so that the compressor can recompress the refrigerant to perpetuate the refrigerant cycle.

Liquid refrigerant remaining within the evaporator shell pools in the bottom of the evaporator. The liquid refrigerant is brought into heat exchange with the portion of the tube bundle that is immersed in the liquid. A pump or some other conventional means can return the liquid to any appropriate inlet associated with the evaporator.

Typical evaporators used in a chiller system have a suction baffle near the inlet of the suction tube. A function of the suction baffle in an evaporator is to minimize the carryover of liquid refrigerant into the suction tube or line during chiller operation. Due to design constraints, the suction inlet and suction tube in conventional evaporators are attached near the top of the evaporator, generally directly above the suction baffle, increasing the height of the evaporator.

Typical evaporator designs also include a region between the tube bundle and the suction baffle for refrigerant droplets to separate from the vapor flow. This region, termed droplet drop-out region, is also designed to minimize the amount of liquid refrigerant entering the suction tube.

A problem exhibited by evaporators of small size and capacity is that the inlet of the suction tube is relatively large and would intrude into the space below the suction baffle or droplet drop-out region if located too far from the top. In evaporators of small size and capacity, if the inlet of the suction tube intrudes into the space below the suction baffle, the effectiveness of the suction baffle is reduced or eliminated because a direct path is provided for the refrigerant to flow into the suction tube inlet resulting in carry-over of liquid into the suction tube. In this problematic design, the suction tube inlet bypasses the suction baffle, allowing a combination of liquid and vapor refrigerant to enter the suction tube or line to the compressor, thereby reducing the overall efficiency of the refrigerant system and risking damage to the compressor. Design principles used in evaporator design constrain suction baffle design and make it difficult to avoid the protrusion of the suction tube inlet into the vapor space below the suction baffle, especially for small capacity evaporators.

Therefore, what is needed is an evaporator design that prevents direct vapor refrigerant flow into the suction tube inlet and allows for horizontal or tangential placement of the suction tube. Another need is an evaporator design that allows for the suction tube inlet to be located partially below the suction baffle in the droplet drop-out region, thereby allowing for a more compact evaporator design and a more efficient refrigeration system.

SUMMARY

The present disclosure is directed to an evaporator including a shell having a lower portion and an interior wall, and a tube bundle, having a plurality of tubes extending substantially horizontally in the shell. A suction baffle system is positioned in the shell and above the tube bundle. The suction baffle system includes a suction baffle and a passageway. The suction baffle includes a plurality of walls extending toward the interior wall of shell. The passageway extends below at least one of the walls of the suction baffle toward the lower portion of shell and adjacent to the interior wall. A suction tube is attached to the evaporator shell, wherein an inlet of the suction tube is adjacent to the passageway.

The present disclosure is further directed to a falling film evaporator for use in a refrigerant system including a shell having an upper portion and a lower portion, and a tube bundle having a plurality of tubes extending substantially horizontally in the shell. A hood is disposed over the tube bundle. A refrigerant distributor is disposed below the hood and above the tube bundle, and the refrigerant distributor is configured to deposit liquid refrigerant or liquid and vapor refrigerant onto the tube bundle from an evaporator inlet. A suction tube having an inlet is attached to the evaporator shell. A suction baffle system is positioned in the shell above the tube bundle and adjacent to the hood. The suction baffle system includes a suction baffle and a passageway. The suction baffle includes a plurality of walls extending toward the interior wall of shell. The passageway extends into a droplet drop-out region. The passageway is adapted to receive a portion of the inlet of the suction tube.

The present disclosure is further directed to a hybrid falling film evaporator for use in a refrigerant system including a shell having an upper portion, a lower portion, and an interior wall. A lower tube bundle is in fluid communication with an upper tube bundle, the lower and upper tube bundles each include a plurality of tubes extending substantially horizontally in the shell, and the lower tube bundle is at least partially submerged by refrigerant in the lower portion of the shell. A hood is disposed over the upper tube bundle and the hood includes a closed end and an open end opposite the closed end. The closed end of the hood is adjacent the upper portion of the shell above the upper tube bundle. The hood further includes opposed walls extending from the closed end toward the open end adjacent the lower portion of the shell. A refrigerant distributor is disposed above the upper tube bundle and deposits refrigerant onto the upper tube bundle. The opposed walls of the hood substantially prevent cross flow of refrigerant between the plurality of tubes of the upper tube bundle. A suction tube having an inlet is attached to the evaporator shell. A suction baffle system is positioned in the shell above the tube bundle and adjacent to the hood. The suction baffle system includes a suction baffle and a passageway. The suction baffle includes a plurality of walls extending toward the interior wall of shell and includes a plurality of slots formed in the plurality of walls. The passageway extends below at least one of the walls of suction baffle toward the lower portion of shell and adjacent to the interior wall of shell. The passageway is adapted to receive a portion of the inlet of the suction tube.

Other features and advantages of the present disclosure will be apparent from the following more detailed description of the preferred embodiments, taken in conjunction with the accompanying drawings which illustrate, by way of example, the principles of the disclosure. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are typically not depicted in order to facilitate a less obstructed view of these various embodiments of the present disclosure.

BRIEF DESCRIPTION OF THE DRAWINGS

Wherever possible, the same reference numbers will be used throughout the drawings to refer to the same or like parts.

DETAILED DESCRIPTION OF THE EXEMPLARY EMBODIMENTS

Figure 1:
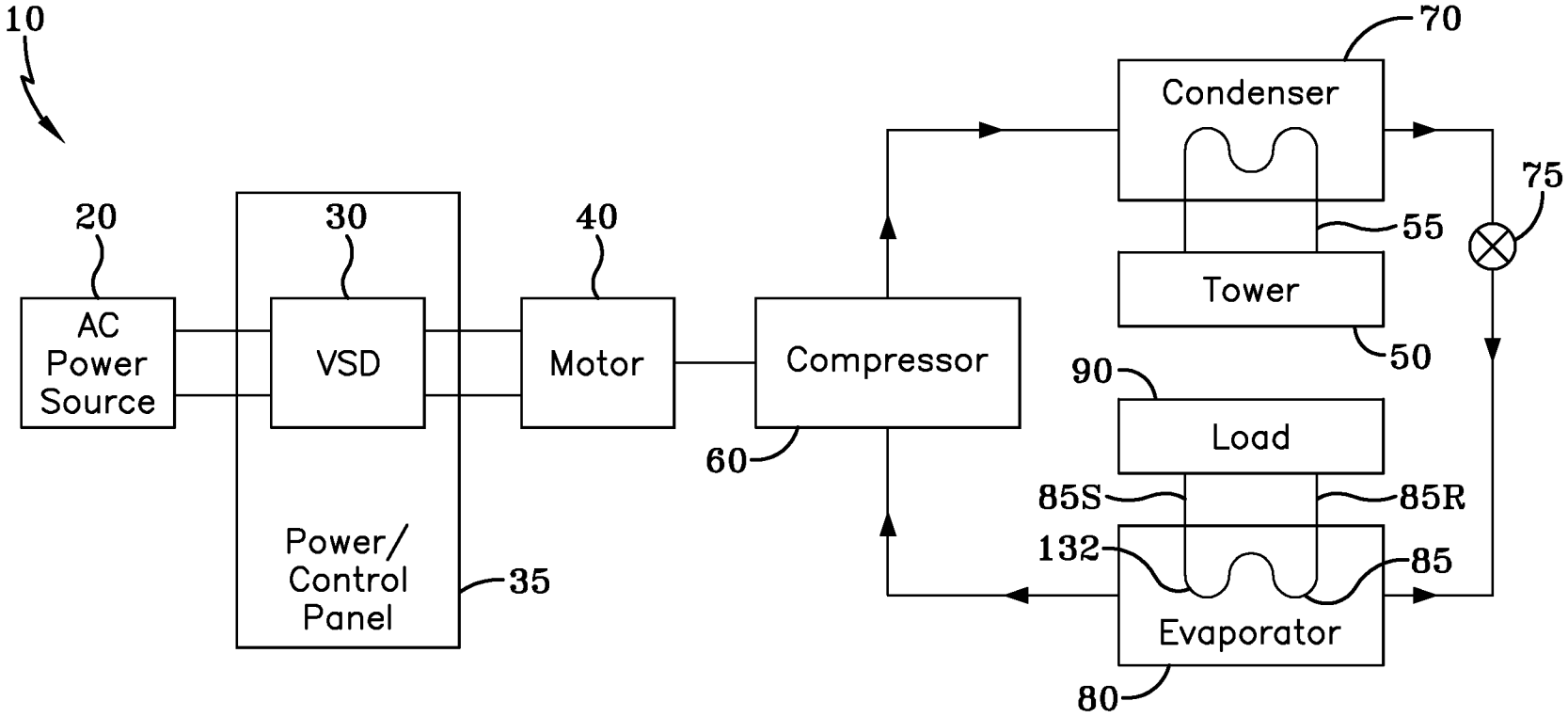
FIG. 1 is a schematic of a refrigerant system of the present disclosure.

FIG. 1 illustrates generally one system configuration of the present invention. A refrigeration or chiller system 10 includes an AC power source 20 that supplies a combination variable speed drive (VSD) 30 and power/control panel 35, which powers a motor 40 that drives a compressor 60, as controlled by the controls located within the power/control panel 35. It is appreciated that the term "refrigeration system" can include alternate constructions, such as a heat pump. In one embodiment of the invention, all of the components of the VSD 30 are contained within the power/control panel 35. The AC power source 20 provides single phase or multi-phase (e.g., three phase), fixed voltage, and fixed frequency AC power to the VSD 30 from an AC power grid or distribution system that is present at a site. It is appreciated that the present invention can also be applied to refrigeration systems that do not use a VSD. In refrigeration systems with these alternate embodiments, the compressor can be directly connected to an electrical power source without a VSD or to other types of power sources such as a turbine. The compressor 60 compresses a refrigerant vapor and delivers the vapor to the condenser 70 through a discharge line. The compressor 60 can be any suitable type of compressor, e.g., centrifugal compressor, reciprocating compressor, screw compressor, scroll compressor, etc. The refrigerant vapor delivered by the compressor 60 to the condenser 70 enters into a heat exchange relationship with a fluid, preferably water, flowing through a heat-exchanger coil or tube bundle 55 connected to a cooling tower 50. However, it is to be understood that the condenser 70 can be air-cooled or can use any other condenser technology. The refrigerant vapor in the condenser 70 undergoes a phase change to a refrigerant liquid as a result of the heat exchange relationship with the liquid in the heat-exchanger coil 55. The condensed liquid refrigerant from the condenser 70 flows to an expansion device 75, which greatly lowers the temperature and pressure of the refrigerant before entering an evaporator 80. A fluid circulated in heat exchange relationship with the evaporator 80 can then provide cooling to an interior space.

The evaporator 80 can include a heat-exchanger coil 85 having a supply line 85S and a return line 85R connected to a cooling load 90. The heat-exchanger coil 85 can include a plurality of heat exchanger tube bundles 132 within the evaporator 80. Water or any other suitable secondary refrigerant, e.g., ethylene, ethylene glycol, or calcium chloride brine, travels into the evaporator 80 via the return line 85R and exits the evaporator 80 via the supply line 85S. The liquid refrigerant in the evaporator 80 enters into a heat exchange relationship with the water in the heat-exchanger coil 85 to chill the temperature of the secondary refrigerant in the heat-exchanger coil 85. The refrigerant liquid in the evaporator 80 undergoes a phase change to a refrigerant vapor as a result of the heat exchange relationship with the liquid in the heat-exchanger coil 85. The vapor refrigerant in the evaporator 80 then returns to the compressor 60 to complete the cycle. It is noted that the chiller system 10 of the present invention may use a plurality of any combination of VSDs 30, motors 40, compressors 60, condensers 70, and evaporators 80.

Figure 2:
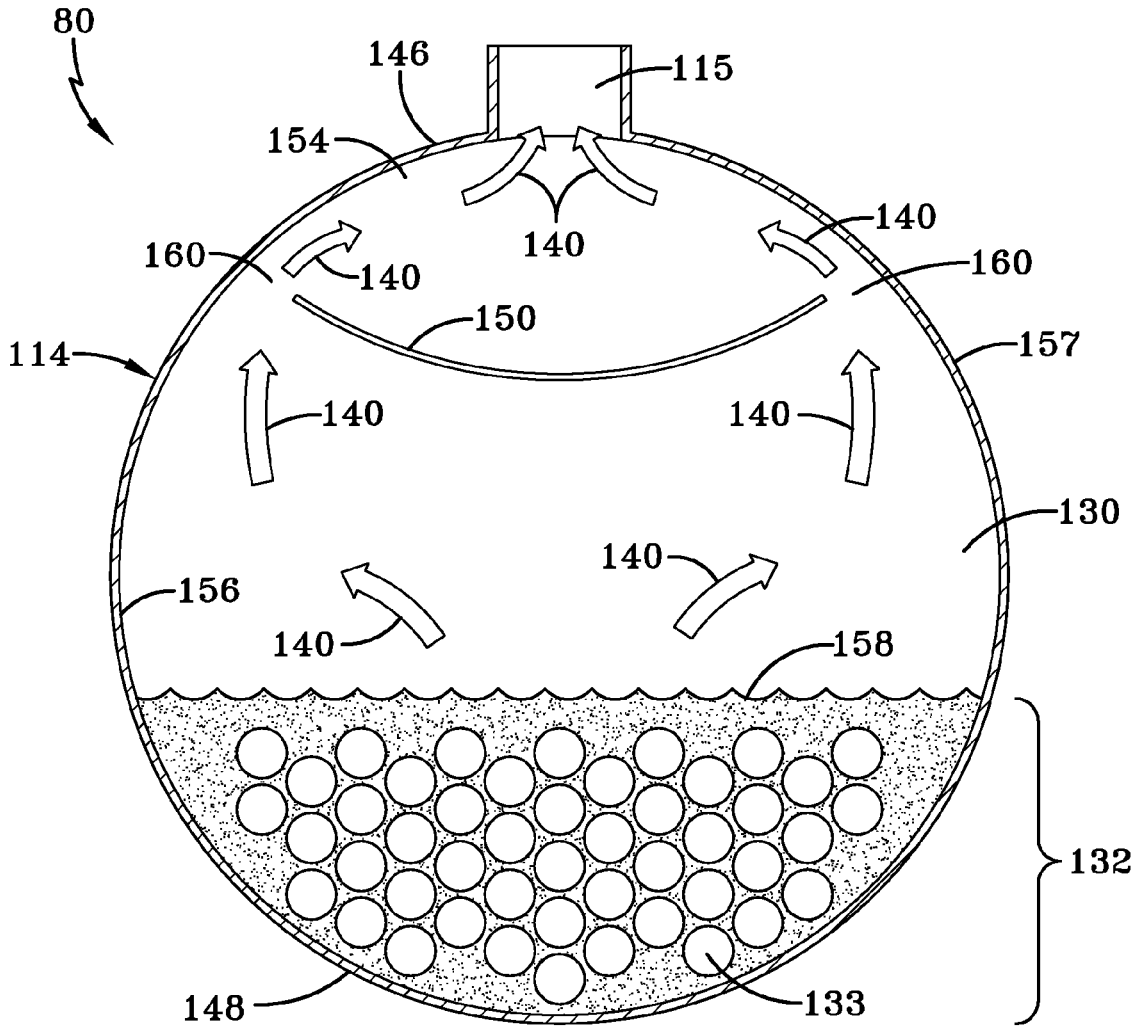
FIG-2 PRIOR ART
FIG. 2 is a schematic of a prior art flooded evaporator with the suction tube attached to the upper portion of the evaporator shell above the suction baffle.

Referring to FIG. 2, a schematic of a prior art flooded evaporator 80 is shown. The flooded evaporator 80 includes a substantially cylindrical evaporator shell 114 having a top or upper portion 146 and a bottom or lower portion 148 with a plurality tubes 133 forming a heat exchanger tube bundle 132. A suitable fluid, such as water, ethylene, ethylene glycol, or calcium chloride brine flows through the tubes 133 of the tube bundle 132. The tube bundle 132 runs the entire length of the flooded evaporator 80 and is covered or partially covered by a liquid refrigerant 158. A suction baffle 150 runs the entire length of the flooded evaporator 80 and is located above the tube bundle 132 and below the upper portion 146 of the flooded evaporator 80. The suction baffle 150 is located proximate the evaporator shell 114 which creates a space 160 between the suction baffle 150 and the evaporator shell 114. A suction tube 115 is attached to the upper portion 146 of the evaporator shell 114 of the flooded evaporator 80. The suction tube 115 is attached to the evaporator shell 114 and is located above the suction baffle 150 and above the droplet drop-out region 130 to reduce liquid carry-over into the compressor 60. The space 160 between the suction baffle 150 and the evaporator shell 114 provides an area to allow the vapor refrigerant 140 to flow from the droplet drop-out region 130 into to the suction channel 154 and then into the suction tube 115 which delivers the vapor refrigerant 140 to the compressor 60 to complete the cycle. It is to be understood that the term droplet drop-out region, as used, characterizes the region between the tube bundle 132 and the suction baffle 150 for refrigerant droplets to separate from the vapor flow.

Figure 3:
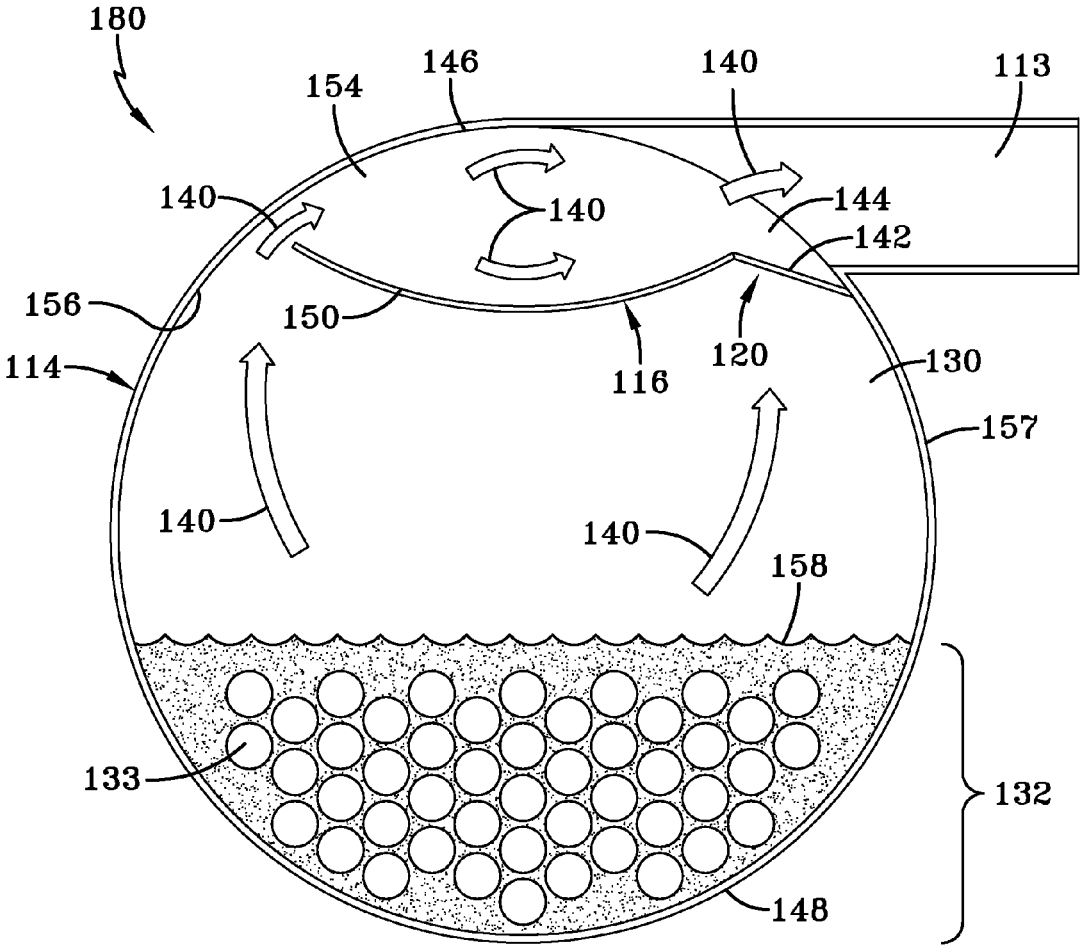
FIG. 3 is a schematic of a flooded evaporator of the present disclosure with the suction tube attached tangentially to the evaporator shell.

Referring to FIG. 3, a schematic of a compact flooded evaporator 180 is shown according to one exemplary embodiment. The flooded evaporator 180 includes a suction baffle system 116, an evaporator shell 114 and a plurality of heat exchanger tubes or tubes 133 formed into a tube bundle 132. The tube bundle 132 extends the length of the flooded evaporator 180 and is covered partially or fully by a refrigerant 158. The suction baffle system 116 includes a suction baffle 150 and a passageway 120. The suction baffle 150 extends substantially the length of the flooded evaporator 180 and is located above the tube bundle 132 and below the upper portion 146 of the flooded evaporator 180. The suction baffle 150 is located proximate to the evaporator shell 114 and includes a plurality of slots 118 (see FIG. 8) that create a space 160 for a vapor refrigerant 140. The passageway 120 is proximate to or protruding from the suction baffle 150. In another embodiment, the passageway 120 may be attached to the suction baffle 150 by a suitable method such as welding or other joining methods. In yet another embodiment, the passageway 120 may be integrally formed with the suction baffle 150 as one continuous piece. In yet another embodiment, the suction baffle 150 and the passageway 120 may be integrally formed from a single substrate, such as, but not limited to, carbon steel or other non-corroding materials. The passageway 120 is configured to generally surroundingly receive or encompass at least portion of an inlet 111 of a suction tube 113 when the inlet 111 is attached to an exterior wall 157 of the evaporator shell 114. It should be understood, that the inlet 111 of the suction tube 113 is attached to the exterior of the evaporator shell 114 and generally does not break into the interior plane of the evaporator shell 114. The passageway 120 is adjacent to the interior wall 156 of the evaporator shell 114 and generally does not break into the exterior plane of the evaporator shell 114. In one embodiment, the passageway 120 includes a bottom surface 142 and at least two passageway sidewalls 144. As shown in FIG. 3, the bottom surface 142 of the passageway 120 extends downward from the suction baffle 150, into a droplet drop-out region 130, allowing the inlet 111 of the suction tube 113 to be located in the droplet drop-out region 130. The passageway sidewalls 144 extend from the bottom surface 142 in a direction toward the upper portion 146 of the evaporator shell 114 and the suction baffle 150 to define the passageway 120. The passageway sidewalls 144 are dimensioned to allow the inlet 111 of the suction tube 113 as attached to the evaporator shell 114 to be positioned between the passageway sidewalls 144 and the bottom surface 142. The bottom surface 142 and the passageway sidewalls 144 of the passageway 120 are placed in close proximity or in abutting relationship to the interior wall 156 of the evaporator shell 114. The arrangement of the suction baffle 150 and the passageway 120 requires the refrigerant to travel in a tortuous path toward the inlet 111 of the suction tube 113, resulting in the liquid droplets entrained in the vapor refrigerant 140 to collide with the interior wall 156 of the evaporator shell 114, the suction baffle 150, or the passageway 120 before entering the inlet 111 of the suction tube 113.

Figure 6:
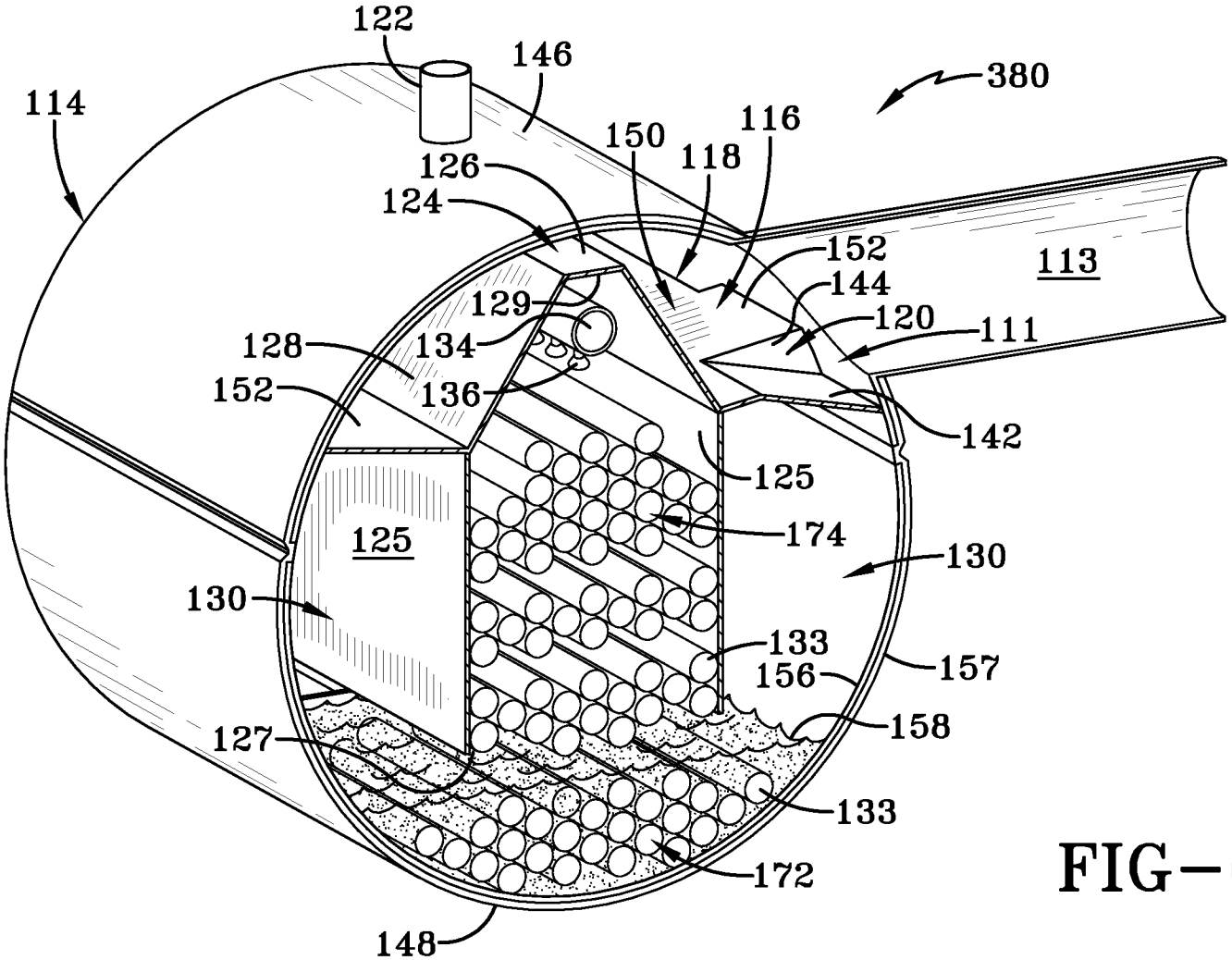
FIG. 6 is a cross sectional taken of the compact hybrid falling film evaporator taken along line 6-6 of FIG. 5.

As further shown in FIG. 3, the passageway 120 prevents the vapor refrigerant 140 in the droplet drop-out region 130 from flowing directly into the inlet 111 of the suction tube 113. The passageway 120 forces the vapor refrigerant 140 to flow through the suction channel 154 to reduce liquid-carry over into the inlet 111 of the suction tube 113. Additionally, the passageway 120 allows the suction tube 113 to be attached tangentially or horizontally to the flooded evaporator 180, which reduces evaporator height, thereby providing a compact flooded evaporator 180. It is to be understood that the term tangentially is used to characterize the orientation between the suction tube 113 and the evaporator shell 114 and does not require that the respective portions of the suction tube 113 and the evaporator shell 114 be coincident, such as shown in FIG. 6. In other words the suction tube 113 and the inlet 111 may be positioned in a non-vertical orientation with respect to the evaporator shell 114 that is not aligned with the center of the evaporator shell 114. In one embodiment, the non-vertical orientation may be arranged so that the connection between the inlet 111 of the suction tube 113 and the evaporator shell 114 is vertically lower than the opposite end of the suction tube 113.

Figure 4A:
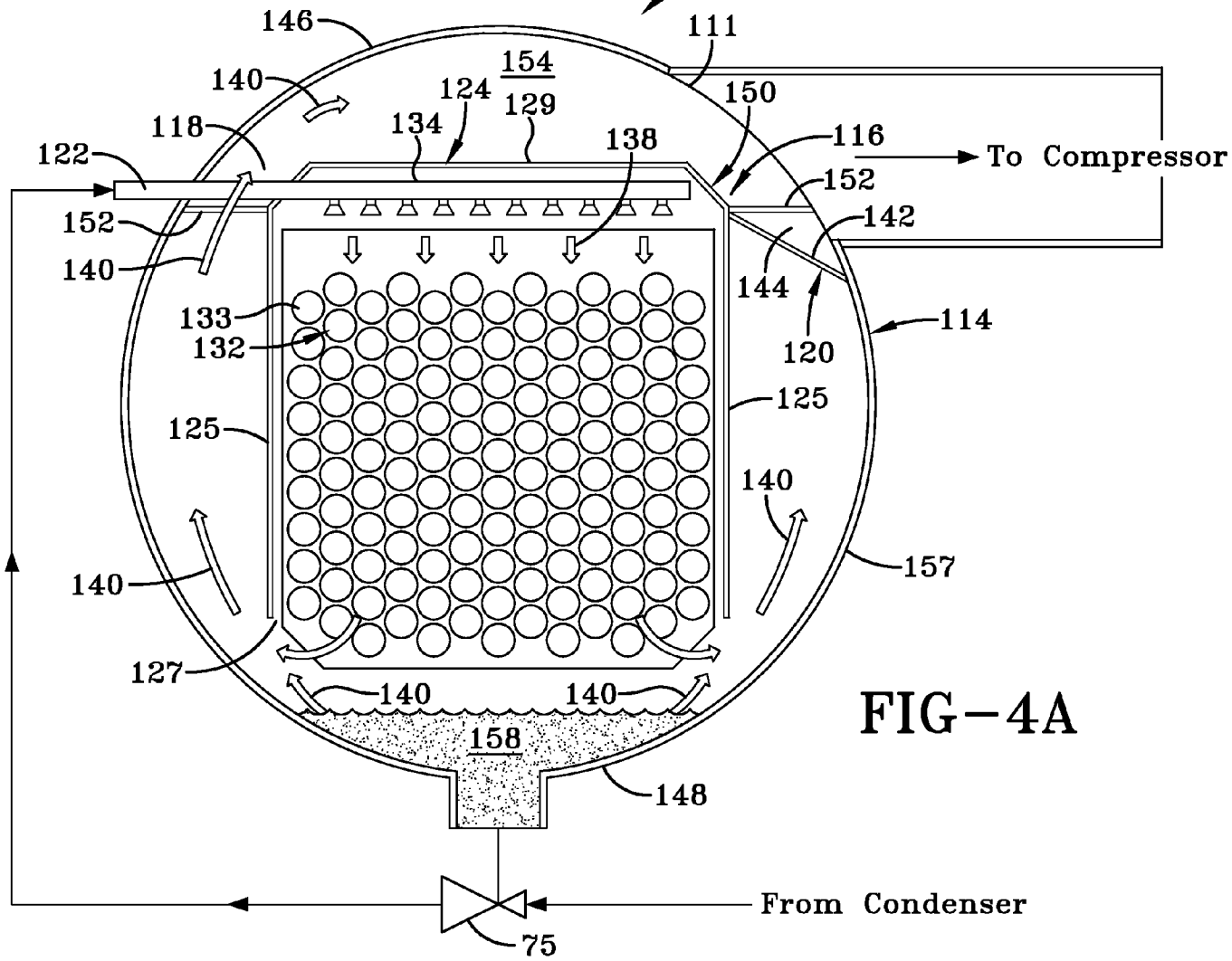
FIG. 4A is a schematic of a falling film evaporator of the present disclosure with the suction tube inlet attached to the evaporator shell.
Figure 4B:
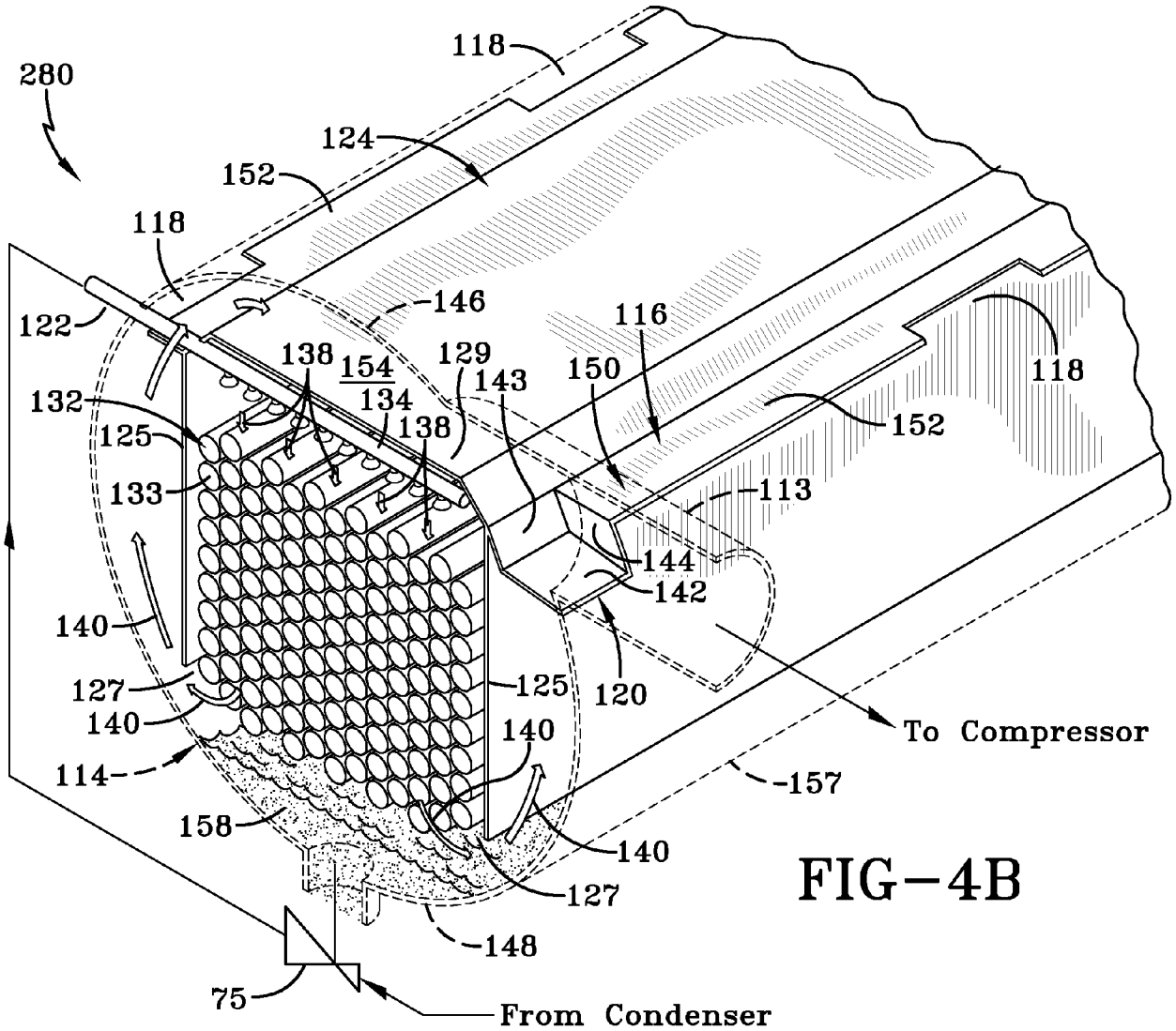
FIG. 4B is a perspective view of a falling film evaporator of the present disclosure with the suction tube inlet attached to the evaporator shell.

Referring to FIGS. 4A and 4B, a compact falling film evaporator 280 is shown according to another exemplary embodiment. The compact falling film evaporator 280 includes a substantially cylindrical evaporator shell 114 having an upper portion 146 and a lower portion 148 with a plurality of tubes 133 forming a tube bundle 132 extending substantially horizontally along the length of an evaporator shell 114. A suitable fluid, such as water, ethylene, ethylene glycol, or calcium chloride brine flows through the tubes 133 of the tube bundle 132. A refrigerant distributor 134 disposed above the tube bundle 132 distributes a refrigerant 138, such as R134*a*, received from the condenser 70 that is in a liquid state or a two-phase liquid and vapor state, onto the upper tubes in the tube bundle 132. In other words, the refrigerant fluid 138 can be in a two-phase state, i.e., liquid and vapor refrigerant. The liquid refrigerant 138 that has been directed primarily by force of gravity between the tubes 133 of the tube bundle 132 without changing state to a vapor collects adjacent the lower portion 148 of the evaporator 280, this collected liquid refrigerant being designated as a liquid refrigerant 158.

Further referring to FIG. 4B, a hood 124 is positioned over the tube bundle 132, substantially laterally surrounding substantially all of the tubes 133 of the tube bundle 132 to substantially prevent cross flow of a vapor refrigerant 140 or of liquid and vapor refrigerant between the tubes 133 of the tube bundle 132. The hood 124 includes an upper or closed end 129 adjacent the upper portion 146 of the evaporator shell 114 above the tube bundle 132 and above the refrigerant distributor 134. In another embodiment, the distributor 134 may be incorporated into the hood 124. In yet another embodiment, portions of the distributor 134 may be exterior of the hood 124, so long as the refrigerant initially dispersed from the distributor 134 and adjacent to the distributor 134 is substantially prevented from flowing through the hood 124. The hood 124 extends from opposite ends of the closed end 129 toward the lower portion 148 of the evaporator shell 114 and includes a plurality of opposed substantially parallel walls 125. In one embodiment, the walls 125 of the hood 124 are neither parallel nor planar in profile. The walls 125 of the hood 124 extend toward and terminate at an open end 127 that is substantially opposite the closed end 129 of the hood 124.

Preferably, the closed end 129 and the walls 125 are closely disposed adjacent to the tubes 133 of the tube bundle 132, with the walls 125 extending sufficiently toward the lower portion 148 of the evaporator shell 114 as to substantially laterally surround the tubes 133 of the tube bundle 132. However, it is not required that the walls 125 extend vertically past the lower tubes of the tube bundle 132, nor is it required that the walls 125 are planar, although the vapor refrigerant 140 that forms within the outline of the tube bundle 132 is channeled substantially vertically within the confines of the walls 125 and through the open end 127 of the hood 124. The hood 124 forces the vapor refrigerant 140 downward between the walls 125 and through the open end 127, then upward in the space or the droplet drop-out region 130 between the evaporator shell 114 and the walls 125 from the lower portion 148 of the evaporator shell 114 to the upper portion 146 of the evaporator shell 114. The vapor refrigerant 140 then flows over a baffle system 116 protruding adjacent to the upper portion 146 of the evaporator shell 114 and into a suction channel 154. The vapor refrigerant 140 enters into the suction channel 154 through the plurality of slots 118 which are spaces between the ends of the baffle 150 and the interior wall 156 of the evaporator shell 114. After entering the suction channel 154 through the slots 118, the vapor refrigerant 140 flows over the suction baffle system 116. The suction baffle system 116 includes a suction baffle 150 and a passageway 120.

As shown in FIG. 4A, the bottom surface 142 of the passageway 120 extends downward from the suction baffle 150, into a droplet drop-out region 130, allowing the inlet 111 of the suction tube 113 to be located in the droplet drop-out region 130. The passageway sidewalls 144 extend from the bottom surface 142 in a direction toward the upper portion 146 of the evaporator shell 114 and the suction baffle 150 to define the passageway 120. The passageway sidewalls 144 are dimensioned to allow the inlet 111 of the suction tube 113 as attached to the evaporator shell 114 to be positioned between the passageway sidewalls 144 and the bottom surface 142. The bottom surface 142 and the passageway sidewalls 144 of the passageway 120 are placed in close proximity or in abutting relationship to the interior wall 156 of the evaporator shell 114.

As shown in FIG. 4B, the passageway 120 is adjacent to the wall 125 of the hood 124 and adjacent to the baffle walls 152 of the baffle 150. The passageway 120 includes a bottom surface 142, a plurality of passageway sidewalls 144 and a connector wall 143. The connector wall 143 abuts the wall 125 of the hood 124 and the connector wall 143 extends downward from the wall 125 into the droplet drop-out region 130 to the bottom surface 142. The bottom surface 142 of the passageway 120 extends downward from the connector wall 143, into the droplet drop-out region 130, allowing the inlet 111 of the suction tube 113 to be located in the droplet drop-out region 130. The passageway sidewalls 144 extend outward from the connector wall 143 in a direction toward the inner wall 156 of the evaporator shell 146. The passageway sidewalls 144 also extend from the bottom surface 142 in a direction toward the upper portion 146 of the evaporator shell 114 and the suction baffle 150 to define the passageway 120. The passageway sidewalls 144 are dimensioned to allow the inlet 111 of the suction tube 113 as attached to the evaporator shell 114 to be positioned between the passageway sidewalls 144 and the bottom surface 142. The bottom surface 142, the connector wall 143, and the passageway sidewalls 144 of the passageway 120 are placed in close proximity or in abutting relationship to the interior wall 156 of the evaporator shell 114.

In both FIGS. 4A and B, the arrangement of the suction baffle 150 and the passageway 120 requires the refrigerant to travel in a tortuous path toward the inlet 111 of the suction tube 113, resulting in the liquid droplets entrained in the vapor refrigerant 140 to collide with the interior wall 156 of the evaporator shell 114, the suction baffle 150, or the passageway 120 before entering the inlet 111 of the suction tube 113. In one embodiment, the passageway 120 abuts the wall 125 of the hood and is positioned below the baffle 150. In one embodiment, the passageway 120 may be welded to the wall 125 and the suction baffle 150. In another embodiment the passageway 120 is integrally formed with the wall 125 and the suction baffle 150. In yet another embodiment, the passageway 120, the wall 125 and the suction baffle 150 can be formed from a single continuous material. In both FIGS. 4A and B, the vapor refrigerant 140 flows through the suction baffle 150 and into the passageway 120, before exiting the evaporator 280 at the inlet 111 of the suction tube 113 that is connected to the compressor 60.

Referring to FIGS. 5-8, a compact hybrid falling film evaporator 380 is shown according to another exemplary embodiment. The compact hybrid falling film evaporator 380 includes an evaporator shell 114, a lower tube bundle 172 in fluid communication with an upper tube bundle 174, a hood 124, a refrigerant distributor 134, a suction baffle system 116, and an inlet 111 of a suction tube 113 tangentially attached to the evaporator shell 114. The evaporator shell 114 includes an upper portion 146, a lower portion 148, an interior wall 156, and an exterior wall 157. The lower tube bundle 172 and the upper tube bundle 174 each have a plurality of tubes 133 extending substantially horizontally in the evaporator shell 114. The lower tube bundle 172 is at least partially submerged by the liquid refrigerant 158 in the lower portion 148 of the evaporator shell 114. The hood 124 is positioned over the upper tube bundle 174 and includes a closed end 129 and an open end 127 opposite the closed end 129. The closed end 129 of the hood 124 is adjacent the upper portion 146 of the evaporator shell 114 above the upper tube bundle 174. The hood 124 further includes a plurality of opposed walls 125 extending from the closed end 129 toward the open end 127 adjacent the lower portion 148 of the evaporator shell 114. The refrigerant distributor 134 is positioned above the upper tube bundle 174 and deposits refrigerant through a plurality of nozzles 136 onto the upper tube bundle 174. The suction baffle system 116 is positioned between the upper portion 146 of the evaporator shell 114 and the upper tube bundle 174, and the suction baffle system 116 is near the hood 124. The suction baffle system 116 includes a suction baffle 150 and a passageway 120. The suction baffle 150 is adjacent to the hood 124 and includes a plurality of suction baffle walls 152 having a plurality of slots 118 formed therein. The suction baffle walls 152 extend from the sloped walls 128 of the hood 124. The passageway 120 extends below at least one of the suction baffle walls 152 toward the lower portion 148 of the evaporator shell 114 and is adjacent to the interior wall 156 of the evaporator shell 114. The passageway 120 extends into a droplet drop-out region 130 and is adapted to receive a portion of the inlet 111 of the suction tube 113.

Figure 5:
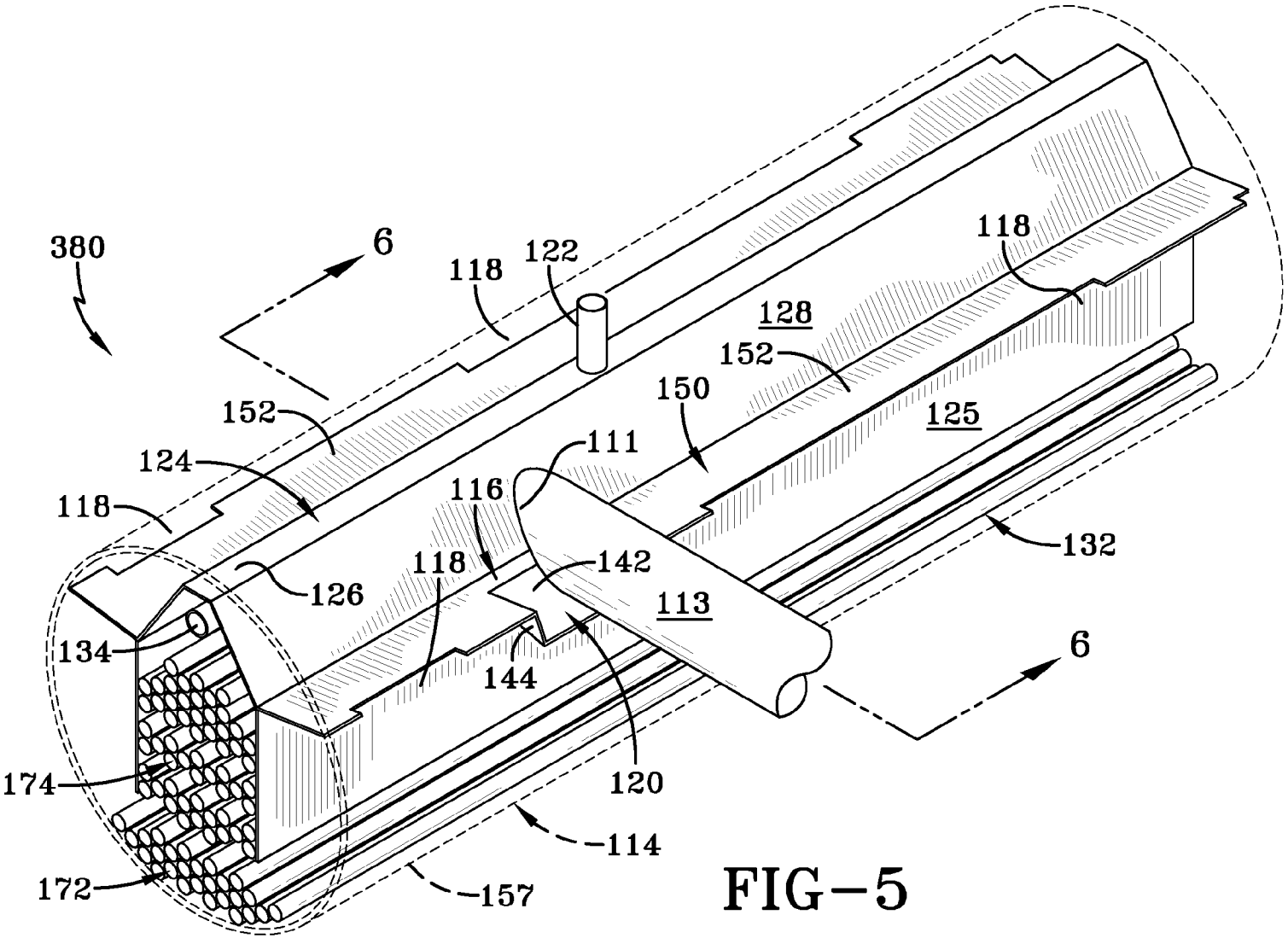
FIG. 5 is perspective view of a compact hybrid falling film evaporator of the present disclosure.

Referring to FIG. 5, the compact hybrid falling film evaporator 380 is shown having the passageway 120 adapted to receive a portion of the inlet 111 of the suction tube 113. The inlet 111 does not generally protrude into or through the interior wall 156 of the evaporator shell 114; however, the inlet 111 is attached to the exterior wall 157 of evaporator shell. The passageway 120 is proximate or abutting the interior wall 156 of the evaporator shell 114. Although the evaporator shell 114 physically separates the passageway 120 from the inlet 111 of the suction pipe 113, the passageway 120 receives the portion of the inlet 111 that is attached to the exterior wall 157 of the evaporator shell 114.

FIG. 6 shows a cross section of FIG. 5 taken along line 6-6. The hood 124 and the suction baffle system 116 of the compact evaporator 380 are shown. The suction baffle system 116 includes the suction baffle 150 having a plurality of suction slots 118 and the passageway 120. The passageway 120 is constructed from carbon steel or any other suitable materials. The passageway 120 includes a bottom surface 142 and a plurality of side passageway walls 144. In another embodiment, the passageway 120 further includes a connector wall 143 (see FIG. 4B). The bottom surface 142 of the passageway 120 extends beneath the opening or inlet 111 to the suction tube 113 attached to the evaporator shell 114. The passageway sidewalls 144 extend from the bottom surface 142 of the passageway 120 in a direction toward the upper portion 146 of the evaporator shell 114 and contact at least one of the suction baffle walls 152. The passageway sidewalls 144 are dimensioned to allow the opening or inlet 111 of the suction tube 113 to be positioned therebetween. The bottom surface 142 and the passageway sidewalls 144 are placed in close proximity or in abutting relationship to the interior wall 156 of the evaporator shell 114 to prevent the force of the suction from the suction tube 113 from drawing entrained liquid in the vapor refrigerant 140 flow stream directly from the droplet drop-out region 130 or region under the suction baffle 150 into the inlet 111.

Figure 7:
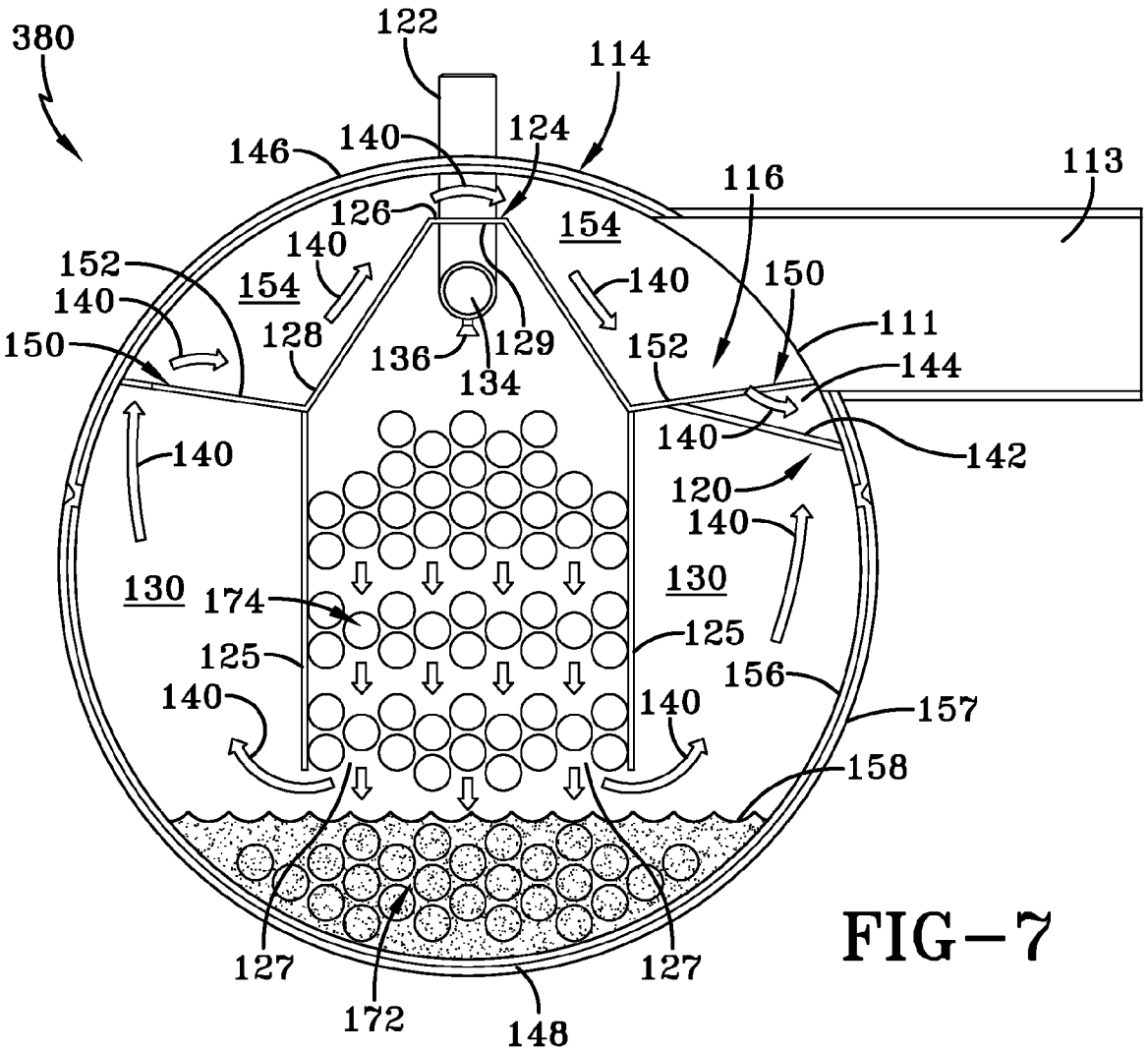
FIG. 7 is a schematic of the compact hybrid falling film evaporator of the present disclosure.

As shown in FIGS. 6 and 7, the evaporator inlet 122 extends through the top of the compact evaporator shell 114 and through the hood 124 to deliver the refrigerant to the distributor 134. In another embodiment, the evaporator inlet 122 may extend through other portions of the evaporator shell 114. The hood 124 is disposed over the upper tube bundle 174. The hood 124 includes a center portion 126 that substantially extends the length of the hood 124, and the sloped walls 128 that extend from either side of the center portion 126. The sloped walls 128 further include a plurality of opposed walls 125 extending from the sloped walls 128 toward the lower portion 148 of the evaporator shell 114. In one embodiment, the opposed walls 125 are substantially planar and parallel to each other. The center portion 126, the sloped walls 128, and the walls 125 of the hood 124 form a closed end 129 near the upper portion 146 of the evaporator shell 114 and an open end 127 near the lower portion 148 of the evaporator shell 114.

Referring to FIGS. 6 and 7, the suction baffle system 116 is positioned between the upper portion 146 of the evaporator shell 114 and above the upper tube bundle 174, and the suction baffle system 116 is adjacent to the plurality of sloped walls 128 of the hood 124. The suction baffle system 116 includes a suction baffle 150, a plurality of suction baffle walls 152, a plurality of slots 118, and a passageway 120. The suction baffle 150 includes a plurality of slots 118 defined by the spacing between the ends of the suction baffle walls 152 and the interior wall 156 of the evaporator shell 114. The suction baffle walls 152 extend from the sloped walls 128 of the hood 124 to create a suction channel 154. The suction channel 154 prevents a direct path of the vapor refrigerant 140, flowing around the hood 124 and through the droplet drop-out region 130, to the inlet 111 of the suction tube 113 which leads to the compressor 60 (see FIG. 1).

Figure 8:
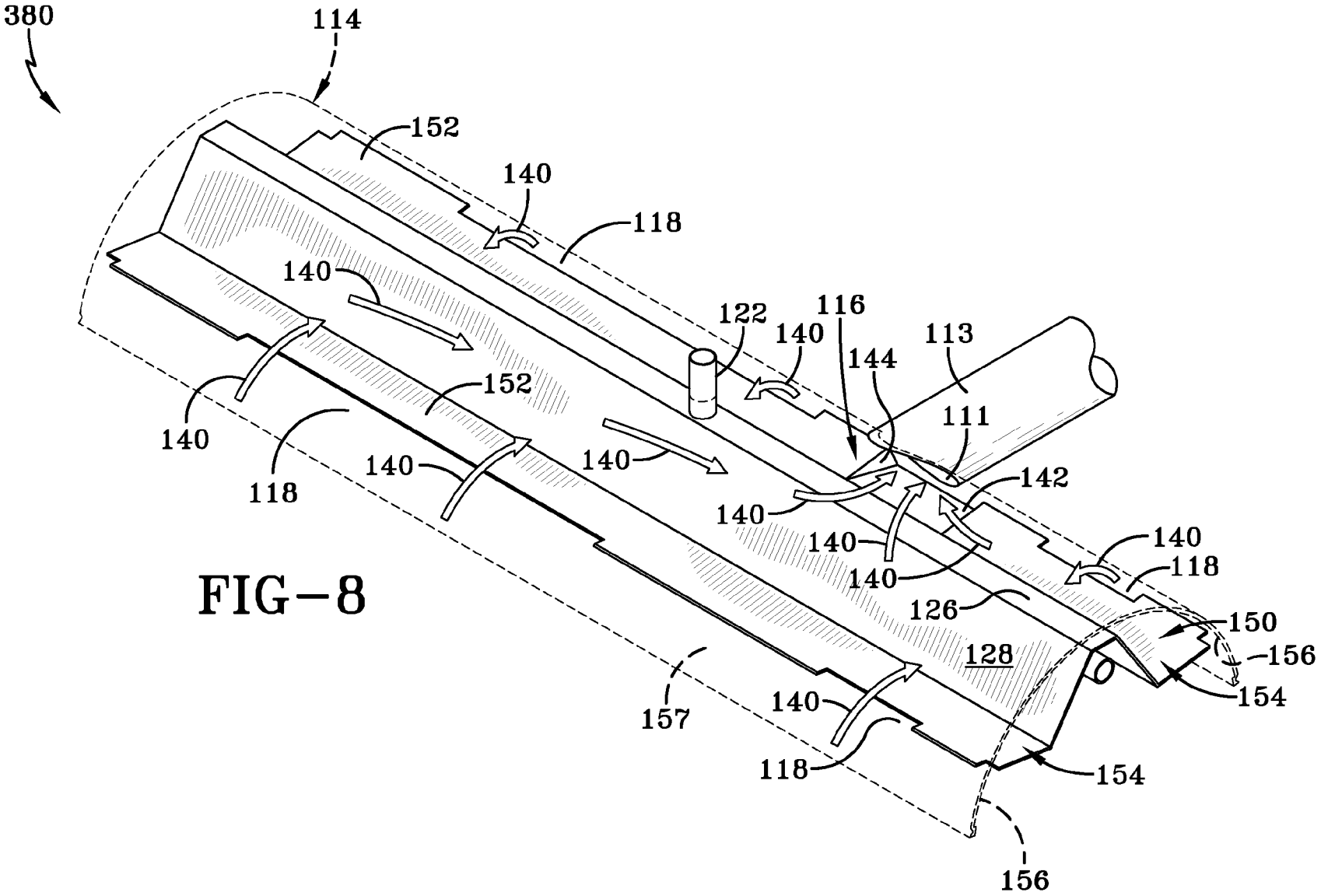
FIG. 8 is a top perspective view of the compact hybrid falling film evaporator of the present disclosure.

Referring to FIG. 7-8, the hood 124 and the suction baffle system 116 of the compact evaporator 380 are better shown. The hood 124 and the suction baffle system 116 substantially extend from one end of the compact evaporator 380 to the other end and substantially prevent the flow of applied refrigerant in the form of vapor and mist at the upper tube bundle from flowing directly into the inlet 111 of the suction tube 113. Instead, by directing the refrigerant to have a downwardly directed flow, the vapor refrigerant 140 must travel downward through the length of the walls 125 of the hood 124 before the refrigerant can pass through the open end 127 of the evaporator 380 or the slots 118 of the suction baffle 150. The walls 125 of the hood 124 substantially prevent cross flow of the extracted vapor refrigerant 140 in the droplet drop-out region 130 from mixing with the liquid and vapor refrigerant traveling through the plurality of tubes 133 of the upper tube bundle 174. That is, prior to the vapor refrigerant being directed between and then past the opposed walls 125, the vapor refrigerant or liquid and vapor refrigerant mixture flowing over the upper tube bundle 174 can only exit the hood 124 through the open end 127.

After the vapor refrigerant 140 passes the open end 127 of the hood 124, containing an abrupt change in direction, the vapor refrigerant 140 is forced to travel between the outside of the walls 125 of the hood 124, the interior wall 156 of the evaporator shell 114 and the suction baffle walls 152, in the droplet drop-out region 130. This abrupt directional change at the ends of the walls 125 of the hood 124 results in a great proportion of any entrained droplets of refrigerant to collide with either the liquid refrigerant or the evaporator shell 114 or the hood 124, removing those droplets from the vapor refrigerant flow 140. Also, refrigerant mist traveling the length of the substantially sloped suction baffle walls 152 is coalesced into larger drops that are more easily separated by gravity, or evaporated by heat transfer on the heat exchanger tube bundle 132. As a result of the increased drop size, the efficiency of liquid separation by gravity is improved, permitting an increased upward velocity of the vapor refrigerant 140 flow through the evaporator 380.

As shown in FIGS. 7 and 8, the suction baffle 150 is proximate the top of the parallel walls 125 and extends into the suction channel 154 to prevent a direct path of the vapor refrigerant 140 to the suction tube 113. The suction baffle 150, protruding adjacent to the upper ends of the walls 125 of the hood 124, includes a plurality of slots 118 defined by the spacing between the ends of suction baffle walls 152 and the interior wall 156 of the evaporator shell 114. The vapor refrigerant 140 enters the suction channel 154 through the plurality of slots 118 of the suction baffle 150 before exiting the evaporator 380 through the passageway 120 substantially surrounding the inlet 111 of the suction tube 113 that is connected to the compressor 60. In other words, the hood 124 and suction baffle system 116 arrangement removes substantially all of the liquid from the vapor refrigerant prior to the vapor refrigerant 140 reaching the inlet 111 of the suction tube 113, with the liquid portion draining to the lower portion 148 of the evaporator shell 114. The passageway 120 is provided proximate the inlet 111 of the suction tube 113 to prevent entrained liquid in the vapor refrigerant 140 flow stream from being drawn into the suction tube 113. The possibility of liquid carryover into the inlet 111 and the suction tube 113 is minimized by the positioning of the hood 124, the suction baffle 150 and the passageway 120. Due to the inclusion of the passageway 120, the vapor refrigerant 140 still has to flow through the suction channel 154 created by the hood 124 and the suction baffle walls 152 before entering the inlet 111 of the suction tube 113, minimizing the possibility of liquid carryover into the compressor 60.

As shown in FIGS. 3-8, unlike current systems, the passageway 120 attached to the suction baffle 150 substantially prevents carry-over, the flow of the vapor refrigerant 140, in the form of vapor and mist, at the top of the tube bundle 132, from flowing directly to the inlet 111 of the suction tube 113 which is fed to the compressor 60. Unlike current systems, the inlet 111 is positioned partially below or below the suction baffle 150 and generally in the droplet drop-out region 130. Also unlike current systems, as a result of the placement of the inlet 111 the suction tube 113 is positioned substantially horizontal or tangential to the evaporator shell 114. The tangential suction tube 113 results in a more compact evaporator 180, 280, 380 and permits an easier and less expensive installation in chillers that have constraints on the overall height of the evaporator. The tangential suction tube 113 also reduces the length of the piping and pipefitting required to connect the compact evaporator 180, 280, 380 to the compressor 60. The tangential placement of the suction tube 113 also results in reduced cost and improved performance, and is easy to manufacture and install.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hybrid falling film evaporator for use in a refrigerant system comprising:

a shell having an upper portion, a lower portion, and an interior wall;

a lower tube bundle in fluid communication with an upper tube bundle, the lower and upper tube bundles each having a plurality of tubes extending substantially horizontally in the shell, the lower tube bundle being at least partially submerged by refrigerant in the lower portion of the shell;

a hood disposed over the upper tube bundle, the hood having a closed end and an open end opposite the closed end, the closed end being adjacent the upper portion of the shell above the upper tube bundle, the hood further having opposed walls extending from the closed end toward the open end adjacent the lower portion of the shell;

a refrigerant for depositing refrigerant onto the upper tube bundle, and wherein the opposed walls of the hood substantially prevent cross flow of refrigerant between the plurality of tubes of the upper tube bundle;

a suction tube having an inlet, wherein the inlet is attached to the shell; and a suction baffle system positioned in the shell above the tube bundle and adjacent to the hood, the suction baffle system having a suction baffle and a passageway, the suction baffle extending toward the interior wall of the shell and is proximate to or abutting the passageway, the passageway extending below at least a portion of the suction baffle toward the lower portion of the shell and adjacent to the interior wall of the shell; wherein the passageway extends into a droplet drop-out region, the passageway having a wall extending toward the shell adapted to surroundingly receive a portion of the inlet of the suction tube, allowing the inlet of the suction tube to be located partially below the suction baffle in the droplet drop-out region;

wherein the passageway further includes a plurality of sidewalls extending downward from the suction baffle abutting a bottom surface, wherein the bottom surface and plurality of sidewalls are adapted to receive a portion of the inlet of the suction tube.

2. The hybrid falling film evaporator of claim 1, wherein the hood and suction baffle system are constructed from a single substrate.

3. The hybrid falling film evaporator of claim 1, wherein the passageway is welded to the suction baffle.

4. The hybrid falling film evaporator of claim 1, wherein the passageway is integrally formed with the suction baffle.

5. The hybrid falling film evaporator of claim 1, wherein inlet of the suction tube is attached tangentially or horizontally to the shell of the evaporator.

* * * * *